US006191674B1

(12) United States Patent
Adachi et al.

(10) Patent No.: US 6,191,674 B1
(45) Date of Patent: Feb. 20, 2001

(54) IGNITION COIL FOR INTERNAL COMBUSTION ENGINE

(75) Inventors: Norihiro Adachi, Kariya; Yoshihiro Shimoide, Tokai; Kazutoyo Osuka, Gamagori; Kazuhide Kawai, Kariya, all of (JP)

(73) Assignee: Denso Corporation (JP)

( * ) Notice: Under 35 U.S.C. 154(b), the term of this patent shall be extended for 0 days.

(21) Appl. No.: 09/456,546

(22) Filed: Dec. 8, 1999

(30) Foreign Application Priority Data

Dec. 14, 1998 (JP) ..... 10-354084

(51) Int. Cl.[7] ..... H01F 27/02; F02P 11/00

(52) U.S. Cl. ..... 336/90; 336/92; 336/96; 123/634

(58) Field of Search ..... 336/90, 96, 92; 123/634, 635

(56) References Cited

U.S. PATENT DOCUMENTS 5,703,556 * 12/1997 Kikuta et al. ..... 336/83
5,870,012 * 2/1999 Sakamaki et al. ..... 336/107

FOREIGN PATENT DOCUMENTS 8-93616 4/1996 (JP) .
9-115749 5/1997 (JP) .
9-246071 9/1997 (JP) .
10-223464 8/1998 (JP) .
11-74139 3/1999 (JP) .

* cited by examiner

*Primary Examiner*—Michael L. Gellner
*Assistant Examiner*—Anh Mai
(74) *Attorney, Agent, or Firm*—Nixon & Vanderhye PC

(57) ABSTRACT

An ignition coil that can be easily assembled, that assures co-axial alignment of a primary coil, a secondary coil and a center core part, and that generates desired high voltage. A core body is formed to have an outer diameter larger than that of a permanent magnet so that the permanent magnet will not protrude out of the outer peripheral face of the core body. Accordingly, when the center core part is inserted into a secondary spool, the center core part is not caught by the secondary spool and may be readily inserted and assembled therewith. Also, because no bulge is created at the center core part, it is possible to prevent the center core part from tilting within the secondary spool and to readily assure the co-axial alignment of the primary spool, the secondary spool and the center core part. Thus, voltage generated by the secondary coil is prevented from dropping, and high voltage may be applied to the ignition plug.

19 Claims, 3 Drawing Sheets

FIG. 4
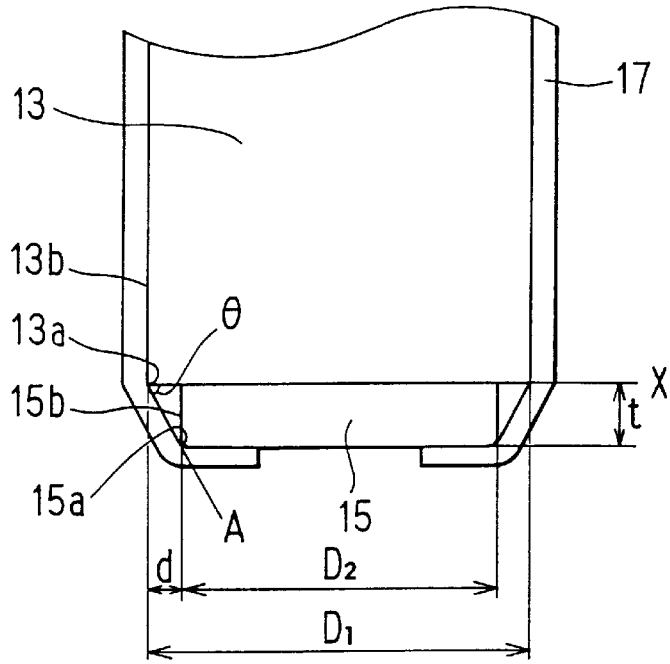
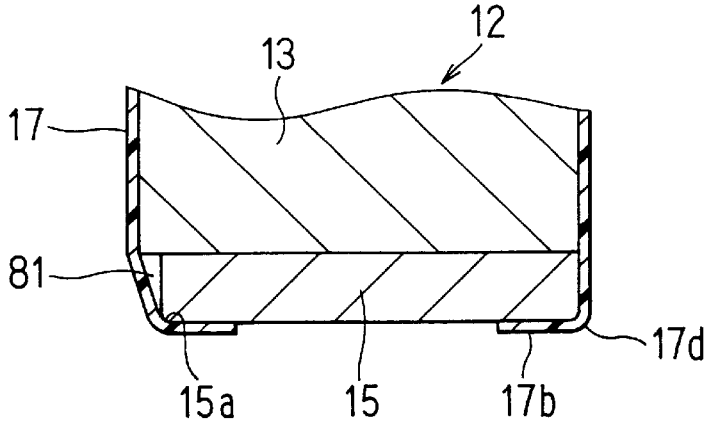
FIG. 5
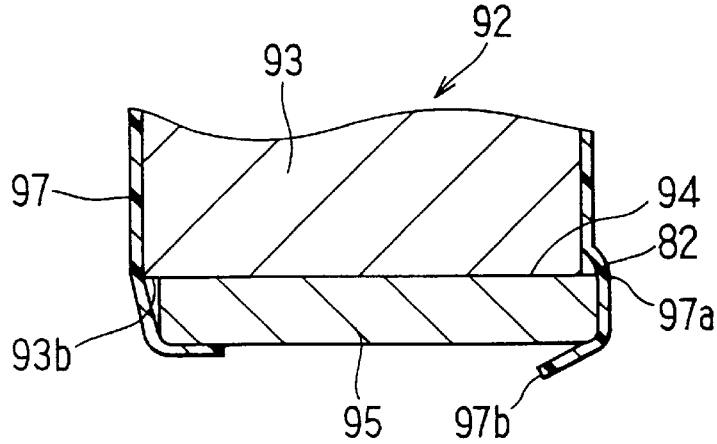
FIG. 6

IGNITION COIL FOR INTERNAL COMBUSTION ENGINE

CROSS-REFERENCE TO RELATED APPLICATION

The present application is related to, and claims priority from, Japanese Patent Application No. Hei. 10-354084, the contents of which are incorporated herein by reference.

BACKGROUND OF THE INVENTION

1. Field of the Invention

The present invention relates to an ignition coil for an internal combustion engine, and more specifically to a stick-type ignition coil directly mounted in an ignition plug hole.

2. Description of the Related Art

One type of conventional stick-type ignition coil for an internal combustion engine includes a center core part having an axially-disposed rod-like core body. A resin spool around which a primary coil and a secondary coil are wound is disposed around the center core part, and resin is filled within a coil housing to insulate the first coil from the second coil. The resin filled within the housing not only acts as an insulator but also prevents the coils from becoming loose, as the resin flows between adjacent wire rods of the coils before hardening.

Another type of conventional ignition coil includes a center core formed by disposing a permanent magnet having almost the same outer diameter as the core body outer diameter at both axial ends of the core body to increase the amount of voltage generated by the ignition coil. Alternatively, an ignition coil may include a rubber cushion member instead of the above-described permanent magnet to reduce axially-directed force acting on the core body due to different expansion coefficients of the respective members to prevent magnetostriction of the core body.

However, as shown for example in FIG. 6, because the core body and the permanent magnet or the cushion member are formed to have almost the same outer diameter, a bulge 82 is created at the interface 94 between the core body 93 and the permanent magnet 95 or the cushion member composing the center core part 92 unless the core body and the permanent magnet or the cushion member are co-axially assembled. Further, because cracks or voids in the insulation will occur where the center core part 92 expands and contacts, along with the resin insulating member and casing members having different expansion coefficients, due to temperature fluctuation, the center core part 92 is covered by a thermo-contractive tube 97 as a resin-made elastic cushion member, for example, to prevent the cracks from occurring.

However, because the thermo-contractive tube 97 also covers the outside of the bulge 82, the thermo-contractive tube 97 also causes a bulge 97*a*. Therefore, assembly time is increased because the spool tends to catch on the bulge 97*a* during assembly of the center core part 92 into the spool of the secondary coil. Further, it is difficult to assure co-axial alignment of the primary coil, the secondary coil and the center core part 92 because the center core part 92 tends to tilt within the spool. As a result, voltage generated by the secondary coil is decreased, and desired high voltage cannot be applied to the ignition plug.

Further, because the thermo-contractive tube 97 is inhibited from shrinking uniformly due to the deformation in the vicinity of the bulge 97*a*, the end 97*b* of the thermo-contractive tube 97 comes off as shown in FIG. 6, the center core part 92 covered by the thermo-contractive tube 97 becomes larger than its predetermined size and the center core part 92 cannot be assembled at the predetermined position within the secondary spool, and the thermo-contractive tube 97 is damaged by a bulge 93*b* of the center core 93 opposite the bulge 97*a*.

SUMMARY OF THE INVENTION

Accordingly, it is an object of the invention to provide an ignition coil that can be easily assembled, that can assure co-axial alignment of a primary coil, a secondary coil and a center core part, and that can generate desired high voltage.

Another object of the invention is to provide an ignition coil that prevents cracks from occurring in the axial vicinity of both end corners of the center core and that generates desired high voltage.

Accordingly, the present invention provides a core body including an outer diameter larger than the outer diameter of a permanent magnet or a cushion member installed at an axial end of the core body, so that the permanent magnet or cushion member may be easily assembled to the core body within the range of the outer diameter of the core body. Consequently, it is possible to prevent the permanent magnet or cushion member from deviating and protruding radially away from the core body.

Further, it is possible to prevent the center core part from being caught within a secondary spool or from tilting within the secondary spool when the core body is assembled with the permanent magnet or cushion member in the secondary spool. Accordingly, the center core part may be readily inserted into the secondary spool. Also, the primary spool, the secondary spool and the center core part may be co-axially aligned, therefore making it possible for desired high voltage to be applied to the ignition plug.

More specifically, the center core part is preferably covered by an elastic cushion member at axial ends of the core body so that casing members surrounding the center core part and the resin insulating member are prevented from directly contacting both axial ends of the center core part.

Also, cracks in the resin insulating material and the casing member near the axial ends of the center core part are prevented, even when the resin insulating material and the casing member have expansion coefficients different from that of the center core part, and expand and contract repeatedly together with the center core part due to temperature changes. Cracks are prevented because the elastic cushion member absorbs the difference in the expansion coefficients of the center core part, the resin insulating material and the casing member. Therefore, voltage generated by the secondary coil is prevented from dropping, and desired high voltage can subsequently be applied to the ignition plug.

Further, the contraction temperature of the thermo-contractive casing member may be made higher than the ambient temperature to prevent expansion damage in the thermo-contractive casing member during coil operation.

The specific nature of the invention, as well as other objects, uses and advantages thereof, will clearly appear from the following description and from the accompanying drawings in which like numerals refer to like parts.

BRIEF DESCRIPTION OF THE DRAWINGS

FIG. 4 is a diagram showing the positional relationship between the core member and a permanent magnet of the ignition plug of the present invention;

FIG. 5 is a partial sectional view of the ignition plug of the present invention; and FIG. 6 is a sectional view of a prior art ignition plug.

DETAILED DESCRIPTION OF THE PREFERRED EMBODIMENT

Figure 1:
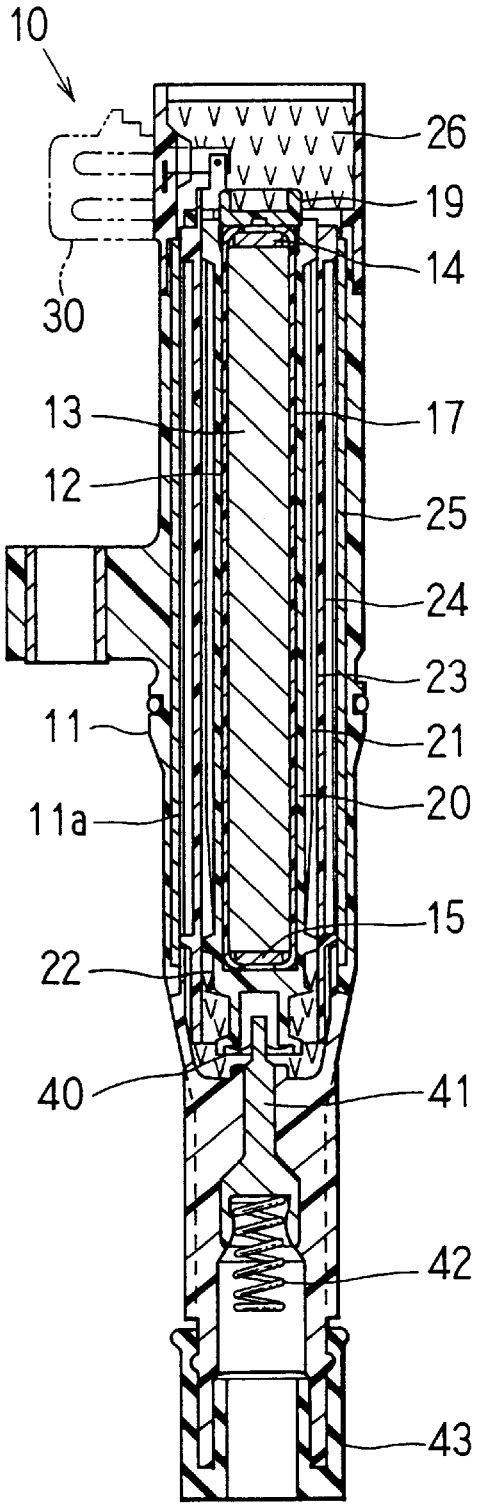
FIG. 1 is a sectional view showing an ignition plug according to a preferred embodiment of the present invention.
Figure 2:
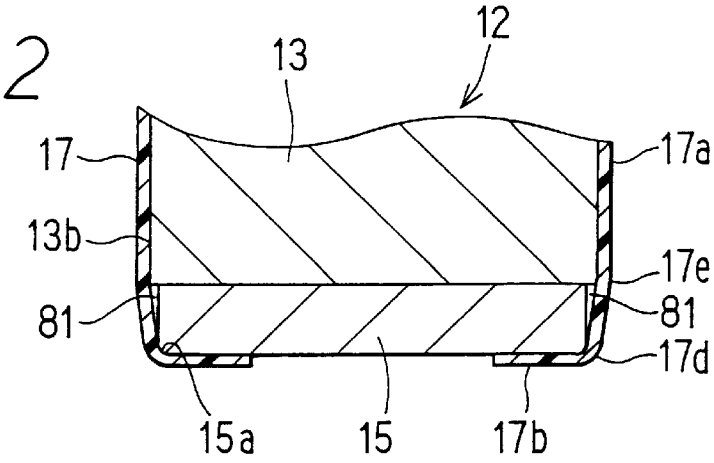
FIG. 2 is an enlarged partial sectional view of the ignition plug shown in FIG. 1.

Referring to FIGS. 1 and 2, an ignition coil 10 is mounted in an ignition plug hole for each cylinder in an engine block (not shown), and is electrically connected to an ignition plug (not shown) also mounted within the plug hole. The ignition coil 10 includes a cylindrical resin housing 11 that defines a storage chamber 11*a*. A center core part 12, a secondary spool 20, a secondary coil 21, a primary spool 23, a primary coil 24, an outer peripheral core 25 and the like are stored in the storage chamber 11*a*. The center core part 12 is composed of a core body 13 and permanent magnets 14, 15 disposed on both sides of the core body 13. Epoxy resin 26 fills in gaps between the respective members within the ignition coil 10. The resin, which is an insulating material, assures electrical insulation among the members.

The cylindrical core body 13 is formed from thin silicon steel plates laminated together in the radial direction so that its resulting cross section is almost circular. The permanent magnets 14, 15 have polarities that are opposite from the direction of generated magnetic flux generated when the magnets are excited by the coil. A thermo-contractive tube, or casing member, 17 covers the core body 13 and acts as an elastic cushion member at the outer periphery thereof. A cap 19 having a through hole is fitted over the permanent magnet 14 covered by the thermo-contractive tube 17. The cap 19 and the secondary spool 20 compose a casing member surrounding the outer periphery of the center core part 12.

Because the thermo-contractive tube 17 is molded into a cylindrical shape and its inner diameter at the time of molding is larger than the outer diameter of the center core part 12, it is possible to insert the center core part 12 in which the permanent magnets 14, 15 are assembled with the core body 13 into the thermo-contractive tube 17. The thermo-contractive tube 17 in which the center core part 12 is inserted shrinks when heated as discussed later and adheres to the center core part 12, except at the location of a concavity 81 formed in the vicinity of the interface between the core body 13 and the permanent magnet 15.

Figure 3:
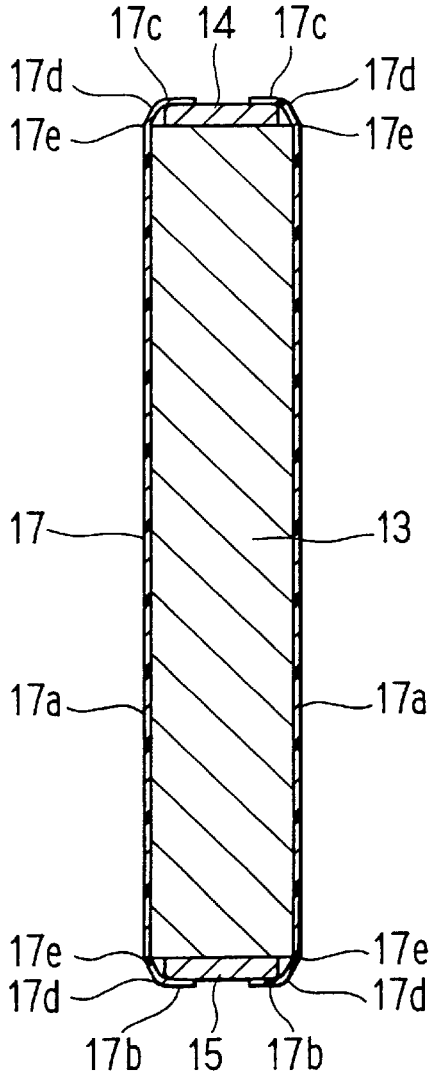
FIG. 3 is a sectional view showing a center core section and a thermo-contractive casing member of the ignition plug of the present invention.

As shown in FIG. 3, the thermo-contractive tube 17 has a cylindrical part 17*a*, ringed parts 17*b*, 17*c* provided at both axial ends of the cylindrical part 17*a*, and first and second edges 17*d*, 17*e* located between the cylindrical part 17*a* and the ringed parts 17*b*, 17*c*, respectively. The cylindrical part 17*a* covers the peripheral side face of the center core part 12, the ringed parts 17*b*, 17*c* respectively cover part of both axial end faces of the center core part 12, the first edge 17*d* covers the end edges of the permanent magnets 14, 15 at both ends of the center core part 12, and the second edge 17*e* covers both end edges of the core body 13.

Preferably, the thermo-contractive tube 17 shrinks at temperatures higher than typical environment usage temperatures (−30° to 150° C.) and the epoxy resin setting temperatures (up to 150° C.) during coil production. This is so because, when the thermo-contractive tube 17 has a damaged section, the damaged section expands due to the shrinkage, and the thermo-contractive tube 17 is therefore not as effective as an elastic cushion member if the shrinkage temperature is lower than the use environment temperature. It is therefore possible to prevent the damaged section from expanding by setting the shrinkage temperature to be higher than the use environment temperature and the manufacturing temperature.

As shown in FIG. 1, the secondary spool 20 is a molded resin cylinder disposed around the thermo-contractive tube 17 and closed at the end of the permanent magnet 15. The secondary coil 21 is wound around the secondary spool 20, and a dummy coil 22 is also wound around the secondary spool 20 on the high voltage side. The dummy coil 22 electrically connects the secondary coil 21 with a terminal plate 40. The surface area of the dummy coil is increased to avoid an electric field from concentrating at the dummy coil 22.

The primary spool 23 is also formed from a molded resin and is disposed around the secondary coil 21. The primary coil 24 is wound around the primary spool 23. A switching circuit (not shown) for supplying a control signal to the primary coil 24 is provided on the outside of the ignition coil 10 and is electrically connected with the primary coil 24 via a terminal that is insert-molded to a connector 30.

The peripheral core 25 is mounted further around the primary coil 24, and is formed by a cylindrically wound thin silicon steel plate. The core 25 has an axial gap, as the beginning of the winding is not connected with the end thereof, and extends from the permanent magnet 14 to the permanent magnet 15.

A high-pressure terminal 41 is insert-molded under the housing 11. The center part of the terminal plate 40 is a claw section bent in the direction in which the high-pressure terminal 41 is inserted to electrically connect the high-pressure terminal 41 with the terminal plate 40. A wire rod at the high voltage end of the dummy coil 22 is electrically connected to the terminal plate 40 by fusing, soldering or the like. A spring 42 is electrically connected to the high-pressure terminal 41 and with the ignition plug when the ignition coil 10 is inserted to the plug hole. A rubber plug cap 43 is attached to the opening end on the high voltage side of the housing 11, and the ignition plug is inserted into the plug cap. When a control signal is supplied from the switching circuit to the primary coil 24, high voltage is generated in the secondary coil 21 and is applied to the ignition plug via the dummy coil 22, the terminal plate 40, the high-pressure terminal 41 and the spring 42.

Next, referring to FIG. 4, the relationship between the outer diameter of the center core part 12 and the outer diameter of the permanent magnets 14, 15 will be explained.

The core body 13 has a diameter $D_1$ larger than the diameter $D_2$ of the permanent magnet 15. The diameter $D_2$ of the permanent magnet 15 is set so as to satisfy the following conditions. When the permanent magnet 15 is assembled with the center core part 12, and when the angle between the radial direction X of the core body 13 and a straight line A connecting an edge 13*a* of the core body 13 and an edge 15*a* of the permanent magnet 15 is θ, θ is preferably between $45° \leqq \theta \leqq 90°$. That is, when the distance from a peripheral face 13*b* of the core body 13 to a peripheral face 15*b* of the permanent magnet 15 is d and the axial length of the permanent magnet 15 is t, preferably $d \leqq t$.

Although θ may be less than 45° if the permanent magnet 15 is capable of enhancing the generated voltage, the thermo-contractive tube 17 may be damaged by the edge 13*a* of the core body 13 if θ is too small. Meanwhile, if 90°<θ, the permanent magnet 15 protrudes out of the core body 13, and a bulge 83 is formed as shown in FIG. 6.

Because the core body 13 has an outer diameter which is larger than the outer diameter of the core body 13 as shown in FIG. 1, a concavity 81 is formed around the permanent magnet 15. Therefore, the permanent magnet 15 will not protrude out of the peripheral face 13*b* of the core body 13 when it is co-axially assembled with the core body 13. Further, even when the permanent magnet 15 cannot be co-axially assembled with the core body 13, the permanent magnet 15 will not protrude and may be disposed in diametric alignment with the core body 13 readily within the range of the outer diameter of the core body 13 as long as the degree of deviation is as shown in FIG. 5.

Also, because the thermo-contractive tube 17 may be prevented from being deformed at the time of shrinkage and the end of the thermo-contractive tube 17 may be prevented from being peeled off from the end face of the permanent magnet 15, the center core part 12 may be maintained with the above-mentioned predetermined shape. Accordingly, the center core part 12 may be assembled in the predetermined position to prevent the thermo-contractive tube 17 from being damaged.

In addition, because no bulge is formed on the center core part 12, the center core part 12 is prevented from tilting within the secondary spool 20, thereby ensuring co-axial alignment of the primary spool 23, the secondary spool 20 and the center core part 12. As a result, it is possible to prevent the voltage generated by the secondary spool 20 from dropping, and it is possible to apply the desired high voltage to the ignition plug.

Therefore, according to the present invention, because no bulge is created on the center core part 12, the thermo-contractive tube 17 is prevented from being damaged in the vicinity of the interface between the core body 13 and the permanent magnet 15 when the thermo-contractive tube 17 shrinks. Further, according to the present invention, it is possible to prevent the peripheral side face of the center core part 12 and the end edge of the permanent magnets 14, 15 from directly contacting the secondary spool 20 and the epoxy resin 26 by covering the peripheral side face of the center core part 12 and the end edge of the permanent magnets 14, 15 with the thermo-contractive tube 17. Also, the thermo-contractive tube 17 can deform elastically during temperature changes to absorb the difference in component expansion coefficients even when the center core part 12, the secondary spool 20 and the epoxy resin 26 having different expansion coefficients.

Accordingly, because it is possible to prevent cracks from occurring around the peripheral side face of the center core part 12 and in the secondary spool 20 and the epoxy resin 26 around both end corners of the center core part 12 where cracks are particularly liable to occur, it is possible to prevent discharge from occurring between the high voltage section and the center core part 12. Therefore, desired high voltage may be applied to the ignition plug.

In addition, according to the present invention, even when the core body 13 and the permanent magnet 15 composing the center core part 12 cannot be co-axially assembled, a certain degree of deviation shown in FIG. 5 is permissible. Accordingly, the use of a cylindrical guide member having the inner diameter of the center core part 12 allows the core body 13 and the permanent magnet 15 to be automatically assembled.

Although the permanent magnets 14, 15 have been disposed on both ends of the core body 13 in the embodiment described above, a permanent magnet may be disposed only at one end of the core body 13. Further, it is possible to dispose a cushion member formed of hard rubber or the like at one or both ends of the core body 13 instead of the permanent magnet. This arrangement would prevent magnetostriction caused by an axially-directed force relative to the core body 13 due to the difference of expansion coefficients that would otherwise decrease the permeability of the core body 13.

Alternatively, a laminate member in which the permanent magnet or the cushion member are laminated may be disposed at the end of the permanent magnet as an independent member. In this case, it is possible to prevent damage to the elastic cushion member and the occurrence of cracks and magnetostriction in the same manner as described above by setting the outer diameter of the cushion member to be smaller than the outer diameter of the permanent magnet.

Still more, although the thermo-contractive tube has been applied as the elastic cushion member in the embodiment described above, elastic members such as elastomer resin and rubber may be alternatively utilized.

While the preferred embodiment has been described, variations thereto will occur to those skilled in the art within the scope of the inventive concepts delineated by the following claims.

What is claimed is:

1. A high-voltage internal combustion engine ignition coil, comprising:

a center core part having a core body and a permanent magnet disposed at at least one end of the core body; and a cushion member covering an outer surface of the core body and the permanent magnet so that the permanent magnet is disposed within an outer periphery of the cushion member, wherein an angle θ between a bottom surface of the core body and an imaginary straight line A between a bottom edge of the core body and a top edge of the permanent magnet satisfies a condition of $45° \leqq \theta \leqq 90°$.

2. The ignition coil of claim 1, wherein an outer diameter of the permanent magnet is smaller than an outer diameter of the core body.

3. The ignition coil of claim 1, wherein the core body comprises a plurality of laminated steel plates.

4. The ignition coil of claim 1, wherein the cushion member has a shrink-fit temperature higher than a coil environment use temperature.

5. The ignition coil of claim 4, wherein the shrink-fit temperature is greater than or equal to 150°0 C.

6. The ignition coil of claim 1, further comprising primary and secondary coils disposed in radial relation to one another around the center core part.

7. The ignition coil of claim 1, further comprising a housing member for housing the ignition coil and being filled with a resin insulating material.

8. A high-voltage internal combustion engine ignition coil, comprising:

a center core part having a core body and a first cushion member disposed at at least one end of the core body; and a second cushion member covering an outer surface of the core body and said first cushion member so that said first cushion member is disposed within an outer periphery of the second cushion member;

wherein an outer diameter of the first cushion member is smaller than an outer diameter of the core body, and wherein the second cushion member has a shrink-fit temperature higher than a coil environment use temperature.

9. The ignition coil of claim 8, wherein the core body comprises a plurality of laminated steel plates.

10. The ignition coil of claim 8, wherein an angle θ between a bottom surface X of the core body and an imaginary straight line A connecting a bottom edge of the core body and a top edge of the first cushion member satisfies a condition of $45° \leqq \theta \leqq 90°$.

11. The ignition coil of claim 8, wherein the first cushion member is formed from hard rubber.

12. The ignition coil of claim 8, wherein the shrink-fit temperature is greater than or equal to 150° C.

13. The ignition coil of claim 8, further comprising primary and secondary coils disposed in radial relation to one another around the center core part.

14. The ignition coil of claim 8, further comprising a housing member for housing the ignition coil and being filled with a resin insulating material.

15. An engine ignition coil, comprising:

a metal core;

one of a magnet and a cushion member having a width less than that of the metal core and disposed at one end of the metal core;

a thermo-contractive tube shrink-fitted around the metal core and the one of the magnet and the cushion member to maintain the one of the magnet and the cushion member in alignment with the metal core.

16. The ignition coil of claim 15, wherein the thermo-contractive tube has a shrink-fit temperature higher than a coil environment use temperature.

17. The ignition coil of claim 16, wherein the shrink-fit temperature is greater than or equal to 150° C.

18. A high-voltage internal combustion engine ignition coil, comprising:

a center core part having a core body and a permanent magnet disposed at at least one end of the core body; and a cushion member covering an outer surface of the core body and the permanent magnet so that the permanent magnet is disposed within an outer periphery of the cushion member, wherein the cushion member has a shrink-fit temperature higher than a coil enviroment use temperature.

19. The ignition coil of claim 18, wherein the shrink-fit temperature is greater than or equal to 150° C.

* * * * *